United States Patent [19]

Mandel

[11] 4,421,075

[45] Dec. 20, 1983

[54] APPARATUS FOR MAINTAINING A DIESEL ENGINE AT A READY TO START TEMPERATURE

[75] Inventor: Max Mandel, Willowdale, Canada

[73] Assignee: Era Electronics (Canada) Limited, Toronto, Canada

[21] Appl. No.: 415,500

[22] Filed: Sep. 7, 1982

Related U.S. Application Data

[63] Continuation-in-part of Ser. No. 291,758, Aug. 10, 1981.

[51] Int. Cl.[3] ..... F02N 17/02

[52] U.S. Cl. ..... 123/142.5 R; 123/179 BG; 123/180 T

[58] Field of Search ..... 123/142.5 R, 142.5 E, 123/180 T, 179 BG

[56] References Cited

U.S. PATENT DOCUMENTS

| | | | |
|---|---|---|---|
| 1,269,637 | 6/1918 | Olmstead | 123/142.5 R |
| 1,287,266 | 12/1918 | Eberly | 123/142.5 R |
| 1,293,569 | 2/1919 | Stein | 123/142.5 R |
| 1,992,568 | 2/1935 | Connor | 123/142.5 R |
| 2,856,543 | 10/1958 | Dixon et al. | 123/142.5 R |
| 3,308,305 | 3/1967 | Morse | 290/38 R |

*Primary Examiner*—Ira S. Lazarus

*Attorney, Agent, or Firm*—Robert F. Delbridge; Arne I. Fors

[57] ABSTRACT

Apparatus for maintaining a diesel engine at a ready to start temperature includes a sensor responsive to the falling of the engine block temperature to a predetermined low value to actuate the starter for up to a predetermined maximum period of time and to actuate the fuel supply. A sensor responds to the attainment of a predetermined oil pressure corresponding to an engine running condition to de-actuate the starter and continue the actuation of the fuel supply to continue running of the diesel engine. The temperature sensor responds to the raising of the engine block temperature to a predetermined high value to de-actuate the fuel supply and thereby stop the diesel engine.

5 Claims, 1 Drawing Figure

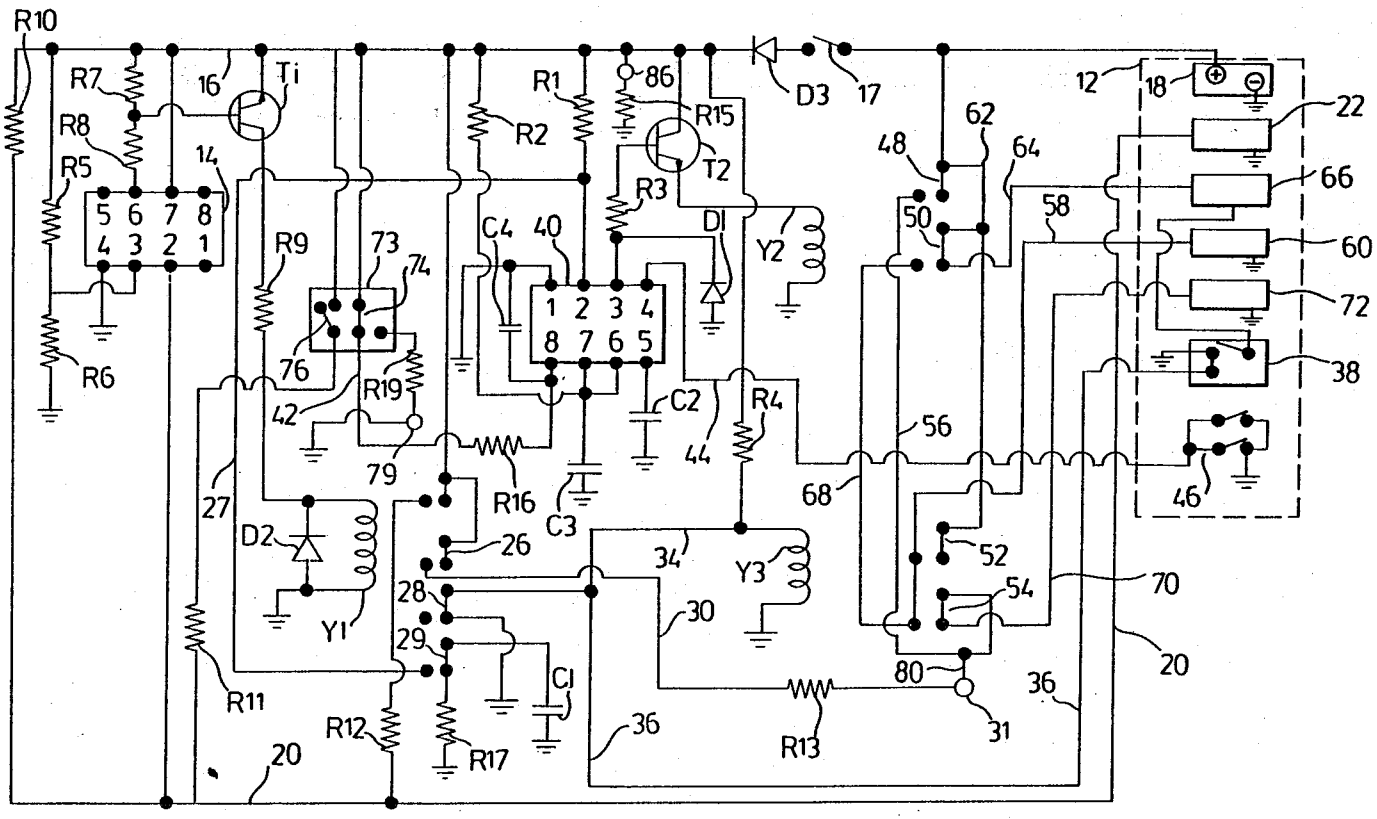
22
66
60
72
38
18
46
12
70
20
58
36
64
54
52
31
62
50
48
56
80
17
68
D3
Y2
R4
Y3
R13
R15
T2
D1
44
C2
30
34
86
R3
36
R1
40
C3
C1
R2
C4
R16
26
R17
74
73
R19
79
28
29
R12
76
42
Y1
T1
R9
D2
20
R11
16
14
27
R7
R8
R5
R6
R10

APPARATUS FOR MAINTAINING A DIESEL ENGINE AT A READY TO START TEMPERATURE

This application is a continuation-in-part of application Ser. No. 291,758 filed Aug. 10, 1981.

The invention relates to apparatus for maintaining a diesel engine at a ready-to-start temperature. The invention is particularly, although not exclusively, applicable to large diesel engines of the kind which are used in trucks, earth moving vehicles, and military vehicles.

It is well known that it is difficult to start many types of diesel engines in cold weather and, so far as the applicant is aware, no satisfactory apparatus is currently available which will maintain a large diesel engine at a ready-to-start temperature without drawing heavily on a battery or requiring an external power source. Apparatus is known which is operable to periodically start and run internal combustion engines of the kind including spark plugs, ignition coils and associated electrical equipment and carburettors, but such apparatus cannot be satisfactorily used with a diesel engine.

It is therefore an object of the invention to provide apparatus which will satisfactorily periodically start and run a diesel engine, especially a large diesel engine, without draining a battery or requiring an external power source.

According to the present invention, apparatus for maintaining a diesel engine at a ready-to-start temperature comprises means responsive to the falling of the engine block temperature to a predetermined low value to actuate the starter for a predetermined period of time and to actuate the fuel supply means, means responsive to the attainment of a predetermined oil pressure corresponding to an engine running condition to de-actuate the starter and continue the actuation of the fuel supply means to continue running of the diesel engine, and means responsive to the raising of the engine block temperature to a predetermined high value to de-actuate the fuel supply means and thereby stop the diesel engine.

Thus, as soon as the engine block temperature has fallen to a predetermined low value, for example about 90° F. (32° C.), the engine is started and runs until the engine block temperature has increased to a predetermined high value, for example about 150° F. (65° C.), at which time the engine is stopped. When the predetermined low engine block temperature is sensed, the starter is actuated for up to a predetermined maximum period of time, for example about 7(seven) seconds, and engine starting is sensed by the attainment of a predetermined oil pressure. Thus, the diesel engine is satisfactorily maintained at a ready-to-start temperature.

The apparatus may also include means responsive to the end of the predetermined period of time to increase the speed of the engine if the engine has started. Thus, initial start-up of the engine may cause the engine to run at an idling speed, with the engine speed being increased to an appropriate higher value at the end of the predetermined period of time. Means may also be provided to obtain a higher than normal idling speed from the commencement of engine running.

The apparatus may also include means responsive to failure of the diesel engine to start during the predetermined period of time to indicate the failure after the predetermined period of time. Thus, if the engine fails to start at the end of a single attempt, this failure is indicated. The apparatus may also include means responsible to failure of the engine to start during the predetermined period of time to prevent a further start attempt being made. The failure of the engine to start at the predetermined low engine block temperature almost certainly means that some fault requiring attention has developed, and in such a case the apparatus does not make further start attempts which may cause further damage.

The means responsive to the falling of the diesel engine block temperature and to the raising of the engine block temperature may comprise an electrical resistor whose resistance varies in accordance with engine block temperature.

The means responsible to the falling of the engine block temperature to the predetermined low value and the means responsive to the raising of the engine block temperature to the predetermined high value may comprise electrical means operated by the falling of the engine block temperature to the predetermined low value to actuate the starter and the fuel supply means and to hold the electrical means in its operated state until the engine block temperature has risen to the predetermined high value.

Such electrical means may comprise relay means actuated by the attainment of the predetermined voltage corresponding to the predetermined low engine block temperature to cause the actuation of the starter and the fuel supply means for the predetermined period of time, the relay means also actuating a holding circuit to maintain a relay operating voltage until the engine block temperature has risen to the predetermined high value.

One embodiment of the invention will now be described by way of example, with reference to the accompanying drawing, which shows an electrical circuit diagram of apparatus for maintaining a large diesel engine at a ready-to-start temperature.

Referring to the drawing, apparatus is provided for maintaining a liquid-cooled diesel engine 12 at a ready-to-start temperature, the diesel engine 12 being of the kind which has a negative ground electrical circuit. The apparatus comprises an operational amplifier 14 with 8 terminals numbered 1 to 8. Terminal 6 is connected through resistors R7 and R8 to a voltage supply line 16 which is connected through diode D3 and an on/off switch 17 to the positive terminal of the battery 18 of the engine 12. The junction of resistors R7 and R8 is connected to the base of a transistor T1 whose emitter is connected to voltage supply line 16 and whose collector is connected through resistor R9 to one end of the coil of a relay Y1. A diode D2 is connected across the ends of the relay coil, and the other end of the relay coil is connected to ground. Terminal 7 of amplifier 14 is connected directly to voltage supply line 16.

Terminal 2 of amplifier 14 is connected through line 20 to an engine block temperature sensor 22 which comprises a thermistor with a negative temperature coefficient which senses the temperature of the engine block of the diesel engine. Thus, as the engine block temperature falls, the electrical resistance of the sensor 22 increases. Terminal 2 is also connected through resistor R10 to voltage supply line 16. Terminal 3 is connected to the junction of resistors R5 and R6 connected between voltage supply line 16 and ground. Terminal 4 is connected to ground, and terminals 1, 5 and 8 are not used.

Relay Y1 has two normally open contacts 24, 26, a normally closed contact 28, and two-way contact 29.

Contact 24 is connected between voltage supply lines 16 and resistor R12 which is connected to engine block temperature sensor line 20. Contact 26 is connected between voltage supply line 16 and a line 30 through a resistor to a failed start indicator 31, which will be described in more detail later. Contact 28 is connected to line 34 which is connected to the junction between resistor R4 and one end of the coil of relay Y3, resistor R4 being connected to voltage supply line 16, and the other end of the coil of relay Y3 being connected to ground. Normally, contact 28 connects line 34 to ground but, when relay Y1 is energized, contact 28 disconnects line 34 from ground. Line 34 is also connected to line 36 which is connected to an oil pressure switch 38 in the lubricating oil circuit of the engine. When the oil pressure in engine 12 is below a predetermined value, the pressure switch 38 connects line 34 and 36 to ground. When the oil pressure rises above the predetermined value, the oil pressure switch 38 disconnects lines 34 and 36 from ground.

An electronic timer 40 has eight terminals numbered 1 to 8. Terminal 8 is connected through resistor R16 and line 42 to normally closed contact 74 of override switch 73 which is connected to line 16. Terminal 2 is connected through resistor R1 to line 16 and also through line 21 to the normally open terminal of contact 29 of relay Y1. Capacitor C1 is connected between the common terminal of contact 29 and ground. Resistor R17 is connected between the normally closed terminal of contact 29 and ground. Terminal 8 is also connected through capacitor C4 to ground.

Terminal 6 and 7 are connected through resistor R2 to line 16 and through capacitor C3 to ground. Terminal 3 is connected through resistor R3 to the base of transistor T2 with a diode D1 being connected between terminal 3 and ground. The collector of transistor T2 is connected to line 16 and the emitter is connected to one end of relay coil Y2. The other end of coil Y2 is connected to ground. Terminal 1 is connected to ground, and terminal 5 is connected through capacitor C2 to ground. Terminal 4 is connected by line 44 to a transmission and hood detector switch 46 which will be described in more detail later.

Relay Y2 has two contacts 48, 50 and relay Y3 has two contacts 52, 54. Normally open contact 48 is connected between the positive terminal of battery 18 and line 56 which is connected to the common terminal of two-way contact 54 and to failed start indicator 32. Two-way contact 50 has a common terminal connected through line 62 to the positive terminal of battery 18 and normally connects line 62 through line 64 to a throttle up solenoid 66 in the diesel engine 12. The function of the throttle up solenoid 66 will be explained later. The open terminal of contact 50 is connected by line 68 to the open terminals of contacts 52 and 54 and by line 58 to fuel control solenoid 60 which controls fuel supply to the diesel engine 12.

Normally open contact 52 has its common terminal connected to line 62 and, when closed, connects voltage supply line 62 through line 58 to the fuel control solenoid 60. Two-way contact 54 normally connects line 56 through line 70 to the engine starter 72, and when relay Y3 is energized contact 54 connects line 56 to line 58 instead of to line 70.

As previously mentioned, line 64 is connected to a throttle-up solenoid 66, and throttle-up solenoid 66 is connected to the oil pressure switch 38 which, when the oil pressure is at the engine running value, connects the throttle up solenoid 66 to ground to complete the circuit therethrough.

The operation of the circuit as so far described will now be explained, assuming that the diesel engine 12 is installed in a truck or other diesel powered vehicle which has been driven to a location where the ambient temperature is less than 40° F. (4° C.). While the diesel engine 12 is running, the temperature of the engine block will be at least 150° F. (65° C.). When the operator switches off the engine, the operator also closes the main switch 17 of the readiness-maintaining circuit. Owing to the relatively high temperature of the engine block, the engine block sensor 22 has a low resistance and the amplifier 14 does not produce a sufficient voltage at the base of transistor T1 to effect conduction thereof. As the temperature of the engine block falls, the resistance of the engine block temperature sensor 22 increases and thereby causes the voltage at terminal 2 of the amplifier 14 to increase.

When the temperature of the engine block has fallen to 80° F. (27° C.), the voltage at terminal 2 of amplifier 14 has risen to a value such that the voltage on the base of transistor T1 causes transistor T1 to conduct, thereby energizing relay Y1. Thus, contact 24 connects resistor R12 between voltage supply line 16 and terminal 2 of amplifier 14, thereby putting resistor R12 in parallel with resistor R10, and thus raising the voltage at terminal 2 to a higher value. As will be more clearly apparent later, this means that the voltage at terminal 2 will not fall to a value causing transistor T1 to cease conduction until the engine block temperature sensor 22 has sensed a temperature considerably higher than that which originally caused the amplifier 14 to effect conduction by transistor T1. In this embodiment, the arrangement is such that the conduction of transistor T1 will not cease until the engine block temperature reaches 155° F. (68° C.).

Energization of relay Y1 also causes contact 26 to connect voltage supply line 16 to line 30, to resistor R13 and the failed start indicator 31. Also, contact 28 opens, and contact 29 connects terminal 2 of amplifier to capacitor C1 instead of to resistor R17, thereby actuating timer 40 with resultant conduction of transistor T2 and energization of relay Y2.

Energization of relay Y2 causes contact 48 to connect line 56 to the positive terminal of battery 18, and thereby supply voltage through line 70 to the starter 72. Energization of relay Y2 also causes contact 50 to connect voltage supply line 62 to line 68 instead of to the throttle up solenoid line 64. The consequent voltage supply line 68 thus supplies voltage to line 58 to cause operation of fuel control solenoid 60. Thus, the starter 72 is operated and fuel is supplied to the engine by operation of the fuel control solenoid 60. If the engine 12 starts within the operating period of the timer, i.e. within 7(seven) seconds, the oil pressure in the engine will increase to a value sufficient to actuate the oil pressure switch 38, with the result that line 36 is disconnected from ground, thereby causing relay Y3 to be energized from the voltage supply line 16 through resistor R4. Actuation of the oil pressure switch 38 also connects throttle up solenoid 66 to ground.

Energization of relay Y3 causes contact 52 to connect voltage supply line 62 through line 58 to the fuel control solenoid 60, thereby maintaining the supply of fuel to the engine 12, and causes contact 54 to disconnect starter line 70 from voltage supply line 68, thereby discontinuing operation of the starter 72. The engine therefore now runs at a speed set by the fuel control solenoid 60, for example an idling speed of 600–800 rpm. and, at the end of the 7(seven) second time period, the timer 40 de-energizes relay Y2. Contact 48 opens, and contact 50 connects supply line 62 to throttle up solenoid 66 instead of to line 68. Since oil pressure switch 38 has already been actuated, throttle up solenoid 66 is then actuated to cause the engine 12 to operate at a higher speed, for example 900 to 1000 rpm.

Thus, the engine will now run at the higher speed until the engine temperature reaches 155° F., at which time the resistance of the engine block temperature sensor 22 will have fallen to a predetermined low value which causes the voltage at terminal 2 of amplifier 14 to fall to a value to cause transistor T1 to cease conduction. Relay Y1 is then de-energized so that contact 28 grounds line 34 to de-energize relay Y3. De-energization of relay Y3 causes contact 52 to remove voltage from the fuel control solenoid 60, and the engine therefore stops. De-energization of relay Y1 also causes contacts 24 and 26 to open, and de-energization of relay Y3 also causes contact 54 to re-connect line 56 to starter line 70.

The engine then remains stopped until the engine block temperature again falls below 80° F. (27° C.), whereupon the previously described sequence reoccurs. Thus, the engine is maintained at a ready-to-start temperature, being started whenever the engine block temperature falls below 80° F. (27° C.), with each engine running stage being continued until the engine block temperature has reached 155° F. (68° C.).

If the engine did not start within the 7(seven) second period of operation of the timer 40, relay Y3 will not have been energized by engine oil pressure, and relay Y2 will be de-energized at the end of the 7(seven) second time period. Since the engine block temperature does not rise, amplifier 14 will keep relay Y1 energized with the result that timer 40 will not be re-activated. Thus, if the engine does not start within the 7(seven) second time period, no further starts are attempted.

In addition, the trouble light indicator 31 is provided to indicate such an occurrence. The trouble light indicator 31 is a light emitting diode whose cathode is connected via line 80 to line 56. The anode of indicator light 32 is connected through resistor R13 to line 30. If the engine fails to start, opening of contact 48 by de-energization of relay Y2 isolates line 56 from the positive terminal of battery 18. A circuit is therefore conducted from line 30 through indicator light 31 and line 70 to ground, thereby activating indicator light 31.

It was previously mentioned that a transmission and hood detector switch 46 is connected to terminal 4 of timer 40. The switch 46 has two normally open switch contacts, one of which is connected to the gear selector of the engine and the other of which is connected to the hood of the vehicle, such that the respective switch unit closes if the transmission is engaged or if the hood is raised to connect line 44 to ground, thereby preventing operation of the electronic timer 40.

In the circumstances, the dirver may wish to keep the engine running at idling speed continuously. In this case, after closing the main on/off switch 17, the override switch 73 is operated. The override switch 73 has two sets of contacts 74, 76. Normally closed contact 74 normally connects line 16 to line 42, but when override switch 73 is operated, contact 74 isolates line 42 and connects line 16 through resistor R19 to an override indicator light 79. Normally open contact 76 connects the positive terminal of battery 18 through resistor R11 to the engine block temperature sensor line to cause the voltage at terminal 2 of amplifier 14 to increase sufficiently to cause transistor T1 to conduct, continuously with resultant energization of relay Y1, thereby permitting continuous engine operation to a pre-set higher temperature in the 185° F. to to 200° F. range (85° C. to 93° C.).

An advantage of the override feature is that the engine block temperature sensor 22 automatically shuts off the engine while running with the override switch 32 engaged, if the engine block temperature rises above a pre-set value as a result of overheating, by causing transistor T1 to cease conduction with resultant de-energization of relays Y1 and Y3. Such overheating could occur for example if the coolant is lost or its circulating pump fails.

To indicate when main switch 17 is closed, indicator light 86 is connected to voltage supply line 16 and to ground through resistor R15.

The majority of the components of the described circuit can be provided as a very compact linear integrated circuit, and the complete circuit may be readily fitted to a diesel engine. The described embodiment is adapted for use with a diesel engine with a negative ground electrical circuit. A person skilled in the art will readily appreciate that the circuit can with appropriate changes be easily adapted for use with a diesel engine with a positive ground electrical circuit. It will also be readily apparent that the invention is applicable to a liquid-cooled or an air-cooled diesel engine.

Other examples and embodiments of the invention will be readily apparent to a person skilled in the art, the scope of the invention being defined in the appended claims.

What I claim as new and desire to protect by Letters Patent of the United States is:

1. Apparatus for maintaining a diesel engine at a ready to start temperature, the diesel engine comprising an engine block, a starter and fuel supply means, the apparatus comprising electrical means providing a signal varying in accordance with engine block temperature, means responsive to the signal when indicating fall of the engine block temperature to a predetermined low value to actuate the starter for up to a predetermined maximum period of time and to actuate the fuel supply means, means responsive to the attainment of a predetermined oil pressure corresponding to an engine running condition to de-actuate the starter and continue the actuation of the fuel supply means to continue running of the diesel engine, and means responsive to the signal when indicating increase of the engine block temperature to a value which is a predetermined amount higher than said lower value to de-actuate the fuel supply means and thereby stop the engine.

2. Apparatus according to claim 1 including means responsive to the end of said predetermined period of time to increase the speed of the engine if the engine has started.

3. Apparatus according to claim 1 including means responsive to failure of the engine to start during said predetermined period of time to indicate said failure after said period of time.

4. Apparatus according to claim 1 including means responsive to failure of the engine to start during said predetermined period of time to prevent re-actuation of the starter.

5. Apparatus according to claim 1 wherein the signal providing means comprises an electrical resistor whose resistance varies in accordance with engine block temperature.

* * * * *